US005475921A

United States Patent [19]

Johnston

[11] Patent Number: 5,475,921

[45] Date of Patent: Dec. 19, 1995

[54] METHOD FOR MAKING CONTACT ASSEMBLY

[75] Inventor: James J. Johnston, Newington, Conn.

[73] Assignee: The Wiremold Company, West Hartford, Conn.

[21] Appl. No.: 101,928

[22] Filed: Aug. 4, 1993

[51] Int. Cl.[6] ..... H01R 43/20

[52] U.S. Cl. ..... 29/878; 29/882; 29/884; 439/886

[58] Field of Search ..... 29/876–879, 881–885; 427/118, 125; 489/66, 886, 888, 889; 451/5, 28; 200/268, 269

[56] References Cited

U.S. PATENT DOCUMENTS 3,851,297 11/1974 Munro ..... 439/66 X 4,418,475 12/1983 Ammon et al. ..... 29/884 X 4,648,211 3/1987 Dawson et al. ..... 451/5

5,046,243 9/1991 Walker ..... 29/878

5,190,486 3/1993 Tsuk ..... 439/886

FOREIGN PATENT DOCUMENTS 327330 8/1989 European Pat. Off. ..... 439/888

*Primary Examiner*—Peter Vo

*Attorney, Agent, or Firm*—McCormick, Paulding & Huber

[57] ABSTRACT

A contact assembly formed from an array of insulated resilient solid wires arranged in spaced apart side-by-side relation to each other and retained in assembly by an ultrasonically assembled two-part carrier strip which extends transversely of the wire array. Notches formed in the wires by grinding define exposed conductive surfaces at selected locations. The conductive surfaces are plated with precious metal to define contact surfaces on the wires which are formed to contact configurations.

11 Claims, 4 Drawing Sheets

METHOD FOR MAKING CONTACT ASSEMBLY

BACKGROUND OF THE INVENTION

This invention relates in general to contact assemblies and deals more particularly with an improved wire contact assembly of the type used in modular telecommunications connectors and with methods for taking such contact assemblies.

A typical contact assembly or contact set of the type with which the present invention is concerned is mounted within the housing of a modular telecommunications connector, as, for example, a standard RJ-45 modular telephone jack, and comprises an array of resilient gold plated solid contact wires. A dielectric plastic contact carrier strip molded onto and extending transversely of the array of tires maintains the contact wires in assembled closely spaced apart side-by-side relation to each other within the housing and more particularly during assembly of the contact set with the housing. However, the process of molding the contact carrier strip in place on the wire array requires a relatively lengthy molding machine cycle. In the past normal shrinkage associated with the carrier strip molding process often resulted in loosely retained contact wires and associated contact misalignment problems, particularly there the wire used in taking a contact assembly had a circular cross-section. This problem has been overcome by coining or otherwise deforming a portion of each of the contact wires and molding the contact carrier strip over the deformed portions of the wires. However, this solution adds an additional step to the process of producing a contact set.

Contact surfaces located on flexing portions of the contact wires and defined by the precious metal coating on the wires are usually located near the free ends of the flexing portions. These contact surfaces are often located on cantilevered portions of the wires, as, for example, in a modular telephone jack of the aforementioned type as is well known in the art. Although the plated contact surfaces comprise only a small percentage of the total surface area of the plated wires the relatively high cost of the gold or other precious metal plating on the wires represents a substantially by large percentage of the overall cost of producing a modular connector.

Accordingly, it is the general aim of the invention to provide an improved contact assembly and method of contact assembly manufacture wherein the quantity of precious metal required to make a contact set is substantially reduced without sacrificing the quality or integrity of the connector in which the contact set is used. A further aim of the invention is to provide an improved contact assembly which includes a contact carrier strip which enables improved wire retention. Yet another aim of the invention is to provide an improved method for attaching a contact carrier strip to an array of contact wires to further reduce the cost of making a contact assembly.

SUMMARY OF THE INVENTION

In accordance with the present invention a contact assembly is made by arranging a plurality of solid contact wires in side-by-side relation to each other, assembling a contact carrier strip with the contact wires retaining the contact wires in fixed side-by-side relation to each other, applying a coating of precious metal to only selected contact surface portions of the contact wires, shearing the contact wires to form free ends on each of the wires, and forming to desired contact configurations portions of the contact wires which include precious metal coated contact surface portions.

DETAILED DESCRIPTION OF PREFERRED EMBODIMENT AND METHOD

Figure 1:
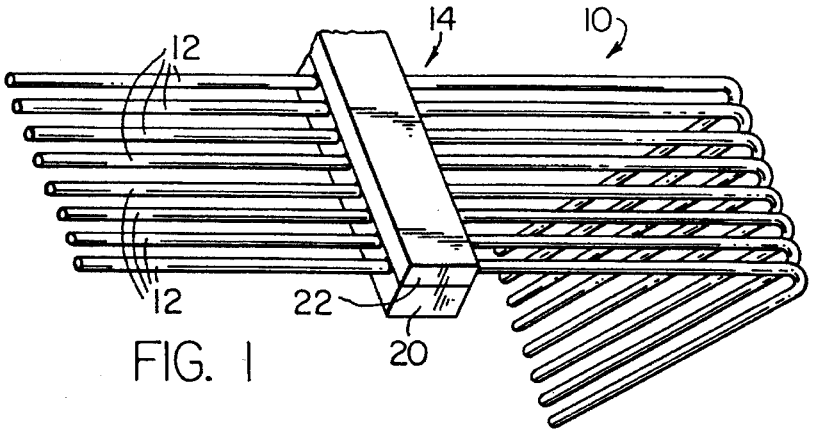
FIG. 1 is a perspective view of a contact assembly embodying the present invention and made in accordance with the invention.
Figure 2:
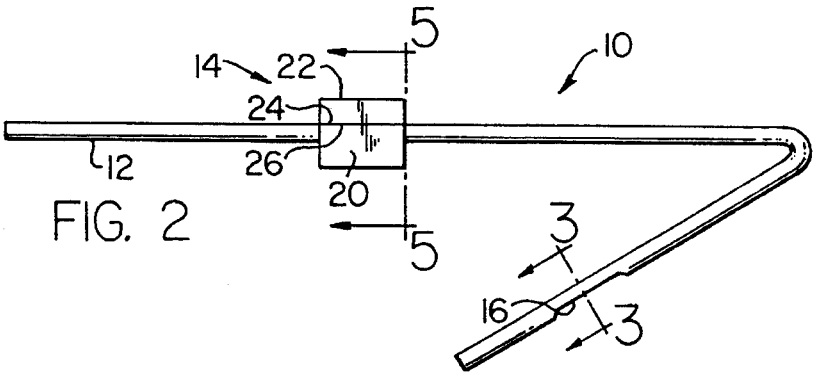
FIG. 2 is a side elevational view of the contact assembly shown in FIG. 1.
Figure 3:
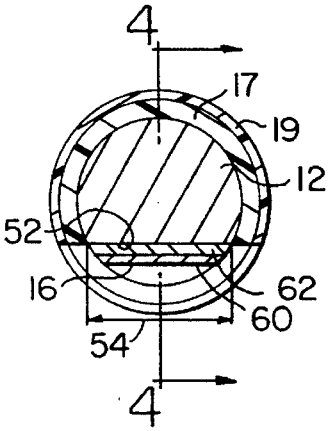
FIG. 3 is a somewhat enlarged sectional view taken along the line 3—3 of FIG. 2.
Figure 4:
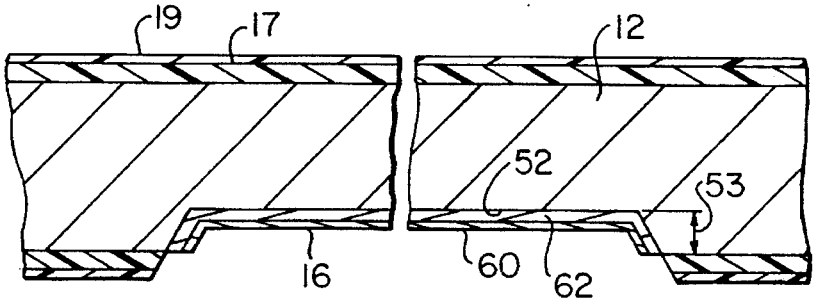
FIG. 4 is a fragmentary sectional view taken along the line 4—4 of FIG. 3.

Turning now to the drawings and referring first particularly to FIGS. 1–2, a formed wire contact assembly embodying the present invention and made in accordance with the invention is indicated generally by the reference numeral 10. The illustrated contact assembly 10 is particularly adapted for use in a modular telecommunications connector of a type well known in the art, such as a standard RJ-45 modular telephone jack, and includes an array of resilient solid contact wires 12, 12 maintained in laterally spaced apart side-by-side relation to each other by a contact carrier designated generally by the numeral 14 and attached to and extending transversely of the wire array. The number of contact wires in the array may vary. However, the illustrated contact assembly 10 includes eight contact wires 12, 12, each wire having two free ends and extending both forwardly and rearwardly from the contact carrier 14. The free end portions of the contact wires at the forward end of the contact assembly 10 are bent downwardly and rearwardly and define cantilevered contacts which include generally forwardly and downwardly exposed contact surfaces 16, 16 (one shown in FIG. 2). Each contact surface 16 is defined by a selectively applied coating of precious metal 60 as shown in FIGS. 3 and 4, all of which will be hereinafter more fully discussed.

The cross-sectional configuration and other physical characteristics of the resilient solid wire used in making a contact assembly in accordance with the present invention may vary. However, the illustrated embodiment 10 preferably employs pre-straightened insulated phosphor-bronze wire of circular cross-section having a diameter generally within the range from about 0.015 to about 0.050 in., No. 25 wire having a diameter of about 0.018 in. and a tensile strength from about 130 to about 150 psi being most preferred. The wire is pre-insulated with suitable dielectric material. As best shown in FIGS. 3 and 4 a coating of 0.0004 in. polyurethane 17 under 0.0002 in. polynylon 19 is presently used and provides an insulation resistance of about 3000 VDC.

Figure 5:
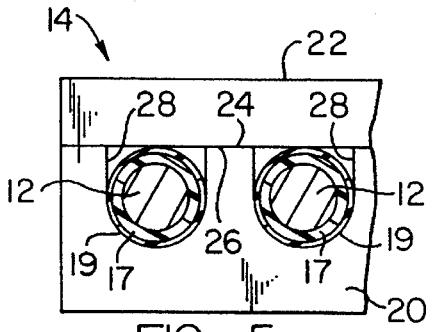
FIG. 5 is a somewhat enlarged fragmentary sectional view taken along the line 5—5 of FIG. 2.
Figure 6:
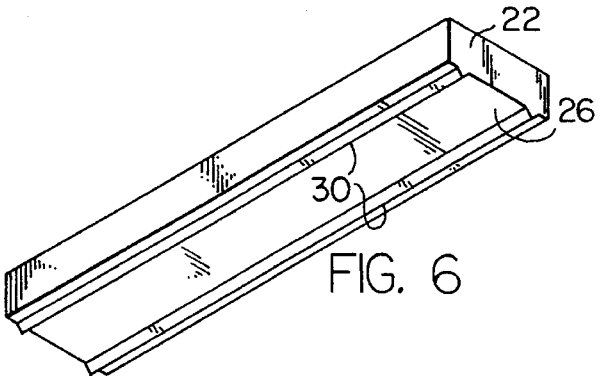
FIG. 6 is a somewhat enlarged perspective view of one of the contact carrier sections.
Figure 7:
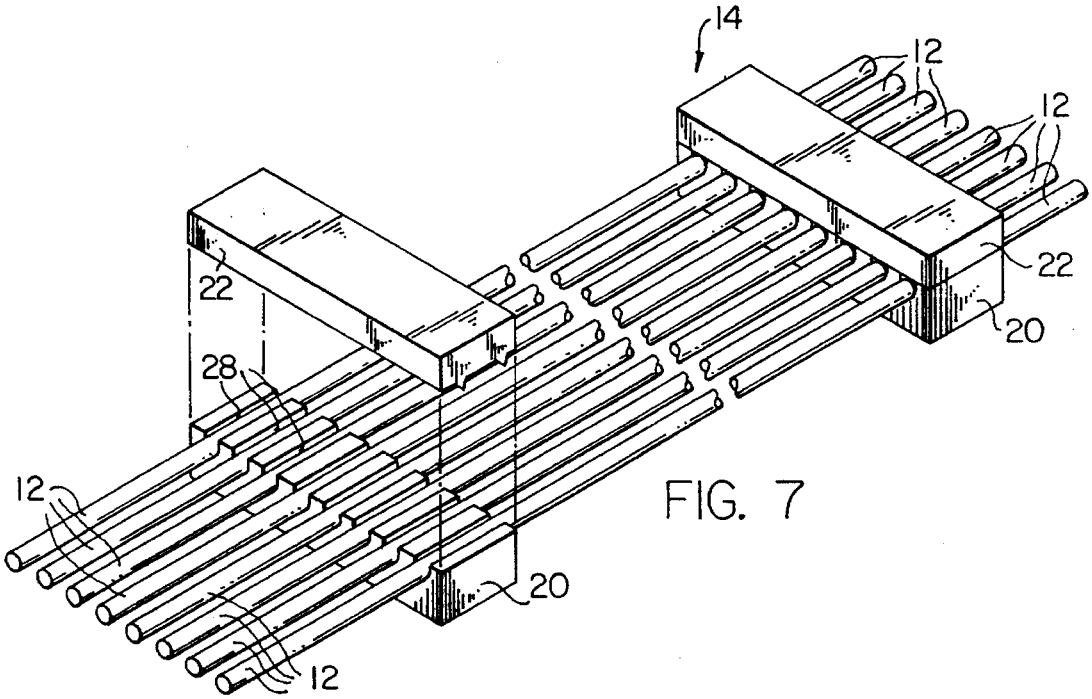
FIG. 7 is a fragmentary perspective view illustrating steps in the assembly of a contact carrier with an array of contact wires.

The contact carrier 14 is formed from a suitable dielectric plastic material and includes a pair of mating contact carrier sections 20 and 22 adapted to be assembled with the contact wires and which have opposing mating abutment surfaces 24 and 26. The sections 20 and 22 receive and capture the contact wires 12, 12 therebetween when the mating abutment surfaces 24 and 26 are brought into coengagement and joined and it is for this reason the section 20 has a plurality of wire receiving grooves 28, 28 which open through the abutment surface 24 as best shown in FIGS. 5 and 7. The inner end of each groove 28 is shaped to substantially complement an associated portion of a contact wire 12. The contact carrier sections may be joined together along the mating surfaces 24 and 26 by any suitable process and may, for example, be adhesively joined. However, an ultrasonic welding process is presently preferred for joining the sections 20 and 22 and for this reason a pair of energy directing ribs 30, 30 project from and extend along the length of the abutment surface 26, as shown in FIG. 6.

Figure 8:
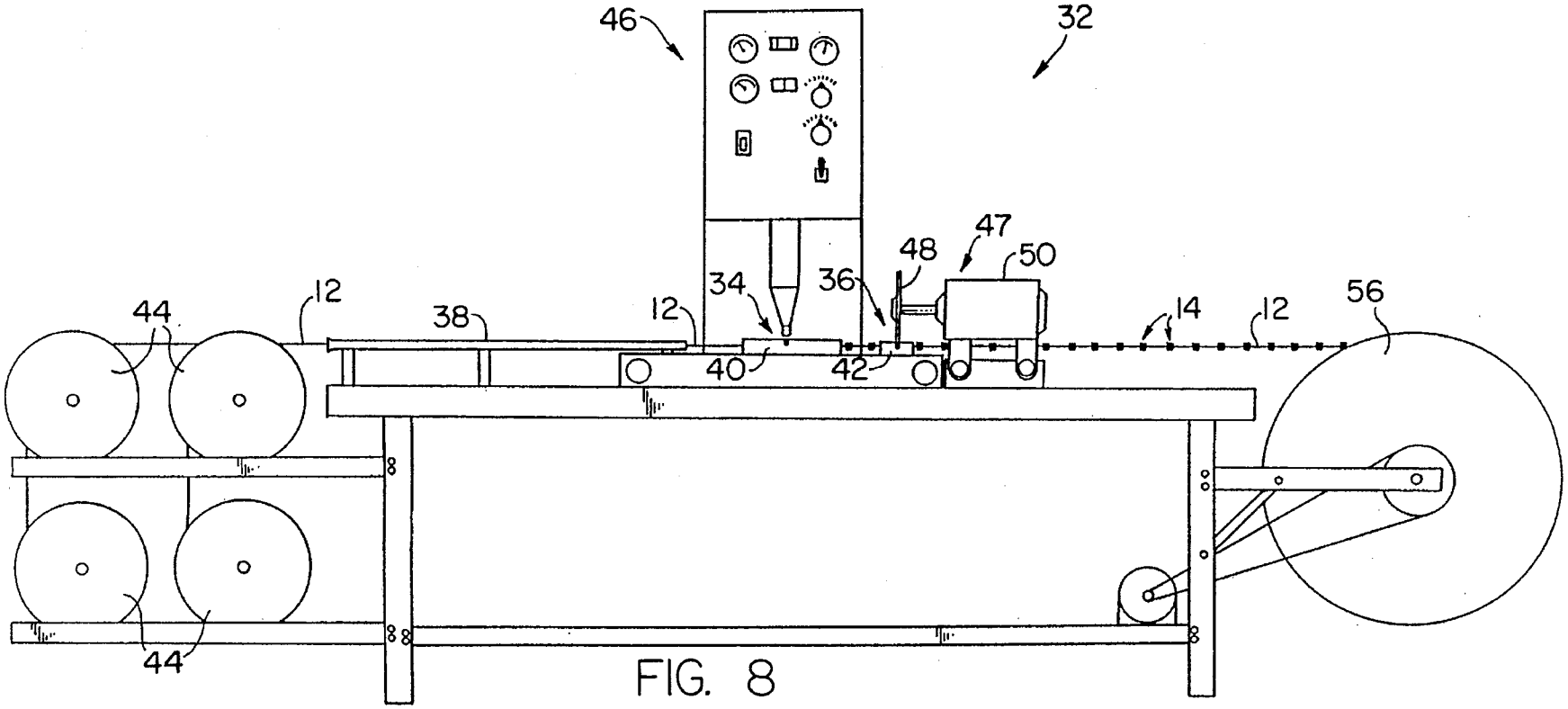
FIG. 8 is a side elevational view of an apparatus for assembling contact carriers on a continuous form array of contact wires and preparing contact surfaces at selected locations along the wires.

The initial steps in the process for forming contact assemblies 10, 10 are preferably performed with the contact wires 12, 12 in continuous form. An apparatus for assembling contact carrier strips 14, 14 with contact wires 12, 12 and preparing contact surfaces at selected locations along the wires is shown in FIG. 8 and indicated generally by the reference numeral 32. The illustrated apparatus 32 includes longitudinally spaced apart work stations indicated generally at 34 and 36. Eight transversely spaced apart longitudinally extending guide tubes 38, 38 (one shown) are supported on the apparatus 32 in axial alignment with holding fixtures 40 and 42 located at the work stations 34 and 36, respectively.

Contact wire 12 is fed to the apparatus 32 from eight spools 44, 44 supported for rotation in axially parallel side-by-side relation to each other on the machine 32 (four spools shown). The wire 12 payed off each spool passes through an associated guide tube 38 and through openings or grooves (not shown) formed in the holding fixtures 40 and 42. The holding fixtures arrange and maintain the contact wires 12, 12 in closely spaced apart side-by-side relation to each other as the wires advance through the work stations 34 and 36.

Contact carrier sections 20 and 22 are preferably fed into the fixture 40 in continuous form and in a direction generally transverse to the direction of wire extent. As each carrier section 20 is fed into the fixture 40 the contact wires 12, 12 at the work station 34 are preferably slightly upwardly bowed by a mechanism (not shown) to allow the lower carrier section 20 to be inserted into the fixture 40 below the wires. When the carrier section 20 is properly positioned within the fixture 40 and relative to the wires 12, 12 the upwardly bowed wires 12, 12 are allowed to return to a normal longitudinally extending position whereby the wires 12, 12 are positioned within the wire receiving grooves 28, 28 in the lower carrier section 20. Thereafter, an ultrasonic welding apparatus indicated generally at 46 and located at the work station 34 moves the carrier sections 20 and 22 relative to each other and applies heat and pressure to the carrier sections bringing the mating abutment surfaces 24 and 26 into coengagement and melting the energy directing ribs 30, 30 whereby the carrier sections 20 and 22 are joined or ultrasonically welded together to form an integral contact carrier 14 encapsulating associated portions of the contact wires 12, 12.

The cycle time required to attach a contact carrier strip 14 to the array of wires 12, 12 by the aforedescribed ultrasonic welding process is substantially shorter than that required to mold a comparable carrier strip in place on the wires. This shorter cycle time coupled with the concentration of heat in the region of joinder results in reduced shrinkage of the carrier strip and better wire retention. The energy directing ribs 30, 30 melt filling the voids between the wires 12, 12 and the wire receiving grooves 28, 28. Thus, the ultrasonically welded carrier strips provide superior wire retention without need for a wire deforming operation presently associated with the molding process for attaching contact carrier strips.

While a contact carrier strip 14 is being attached to the contact wires 12, 12 at the work station 34 contact surfaces are simultaneously prepared on the contact wires at the work station 36. A grinding attachment mounted at the work station 36 and indicated generally at 47 includes a grinding wheel 48 supported for rotation about an axis parallel to the direction of wire extent and driven by a motor 50. The grinding attachment 47 is supported for reciprocal transverse movement relative to the wires 12, 12. The grinding wheel 48 is profiled to form in each wire 12 a shallow notch 52 having a substantially flat inner surface as the grinding wheel traverses the wires and returns to its initial starting position. During the initial pass of the grinding wheel across the wires 12, 12 supported by the fixture 42, portions of the dielectric insulating materials 17 and 19 and the wire material are removed. During the return pass of the wheel additional material is removed exposing virgin metal and forming a notch 52 in each wire. A typical grinding operation performed on a wire of about 0.0192 in. diameter to remove material to a depth of 0.003 in., as indicated at 53 in FIG. 4, will produce a notch having a substantially flat inner surface and a width of about 0.013 in. as indicated by the numeral 54 in FIG. 3.

The contact carriers 14, 14 attached to the continuous form wire array provides a reference surface to facilitate advancement of the array through the apparatus 32 by an associated indexing mechanism associated with the apparatus 32 but not shown. Thus, surfaces are prepared at selected locations along the wires 12, 12 as the wires which comprise the continuous form array are simultaneously intermittently advanced through the machine 32 by the aforementioned indexing mechanism. As the continuous form wire assembly leaves the machine 32 it is wound onto a motor driven take-up reel 56. The drive for the take-up reel 56 may include a slip clutch or other appropriate mechanism to permit continuous operation of the take-up reel and limit tension applied to the wires during the windup operation.

Figure 9:
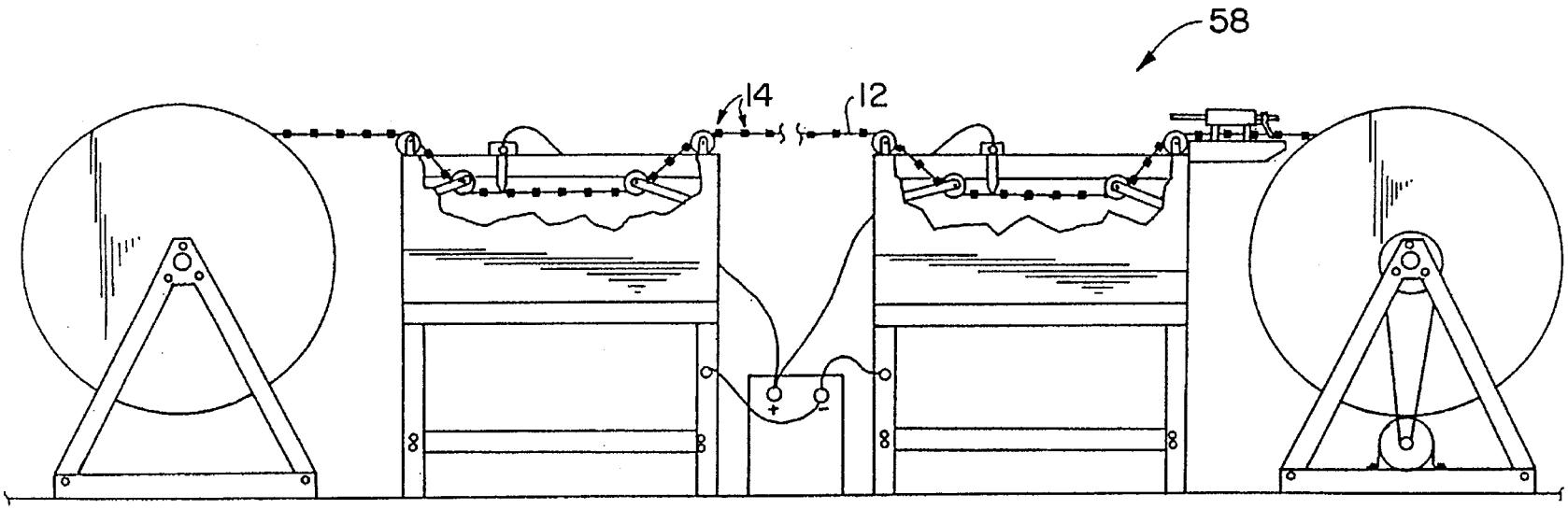
FIG. 9 is a side elevational view of a continuous plating apparatus used in making contact assemblies embodying the invention.

A conventional plating process is employed to apply a coating of precious metal to the exposed conductive surfaces defined on the contact wires 12, 12 by the notches 52, 52. In FIG. 9 there is shown, somewhat schematically, a continuous form plating apparatus indicated generally at 58 which is employed to apply to the selectively exposed notch surfaces of the contact wires a 50 micro gold plate, indicated by the numeral 60, over a 100 micro nickle plate, indicated at 62, to define the contact surfaces 16, 16, as shown in FIGS. 3 and 4. Alternatively, the continuous form wire array received from the machine 32 may be cut into strips of convenient length to be plated by a conventional bulk or rack plating process.

Upon completion of the plating operation the continuous form wire array is sheared to form free ends on each wire 12 spaced from an associated contact carrier 14. The contact assembly 10 is completed by forming desired contact configurations on free ends of the wires 12, 12. In the illustrated embodiment the free ends of the insulated contact wires 12, 12 which include the gold plated contact surfaces 16, 16 are bent downwardly and rearwardly to form cantilever portions to be supported for flexure within an associated modular connector.

It will now be apparent that the present process affords substantial saving of precious metal since only selected portions of the contact wires which comprise the contact surfaces are coated with precious metal. A further advantage results from the increase in contact surface area attained by the present process where wires of circular cross-section are employed.

The insulated coating on the wires 12, 12 not only facilitates the aforedescribed selective plating process but also eliminates all need for insulated tubing and affords opportunity to minimize spacing between adjacent contact wires enabling increased contact density. The use of insulated coating on the contact wires also permits shielding at least between the non-flexing portions of adjacent contact wires which offers further advantages in high frequency transmission. The use of a plastic dielectric rather than an air dielectric enhances transmission characteristics at high frequencies by substantially eliminating crosstalk electrical signals between conductors.

I claim:

1. A method for making a wire contact assembly comprising the steps of intermittently advancing a plurality of resilient longitudinally extending insulated solid contact wires through a plurality of longitudinally extending side-by-side guide tubes and to and through longitudinally spaced apart first and second holding fixtures at first and second work stations, bowing the contact wires upwardly at the first work station, inserting a first contact carrier section into the first holding fixture below the upwardly bowed contact wires, allowing the upwardly bowed contact wires to return to longitudinally extending condition and to position the contact wires relative to the first contact carrier section, moving a second contact carrier section into coengagement with the first contact carrier section and joining the first and second carrier sections to form a contact carrier encapsulating associated portions of the contact wires, removing insulating material from the contact wires at selected locations on the contact wires positioned at the second work station, forming notches in the contact wires at the selected locations exposing virgin metal surfaces to produce a continuous form wire contact assembly, plating the exposed virgin metal surfaces of the contact wires with precious metal, shearing the wires in spaced relation to the contact carrier to form free end portions of the contact wires, and bending the free end portions of the contact wires to define cantilever free end portions which include the notches.

2. A method for making a contact assembly as set forth in claim 1 wherein the step of plating is performed before the step of shearing.

3. A method for making a contact assembly as set forth in claim 1 wherein the step of removing is further characterized as grinding.

4. A method for making a contact assembly as set forth in claim 1 wherein the step of joining is further characterized as adhesively connecting.

5. A method for making a contact assembly as set forth in claim 1 wherein the step of joining is further characterized as ultrasonically welding.

6. A method for making a wire contact assembly as set forth in claim 1 wherein the step of removing insulating material is further characterized as moving a rotating transversely reciprocally moveable grinding wheel in one direction transversely across the contact wires at said second work station and the step of forming notches in the wires is further characterized as moving the transversely reciprocally moveable grinding wheel in a return direction opposite said one direction and transversely across the contact wires positioned at said second work station.

7. A method for making a wire contact assembly as set forth in claim 1 wherein the step of plating the exposed virgin metal surfaces is further characterized as continuously advancing the continuous form wire contact assembly through a plating apparatus and plating the exposed virgin metal surfaces as the continuous form wire assembly is advanced through the plating apparatus.

8. A method for making a wire contact assembly as set forth in claim 1 including the additional step of winding the continuous form wire contact assembly onto a take-up reel and performing the step of winding before the steps of plating, shearing and bending are performed.

9. A method for making a wire contact assembly as set forth in claim 8 wherein the step of plating the exposed virgin metal surfaces is further characterized as continuously advancing the continuous form wire contact assembly from the take-up reel through a plating apparatus and plating the exposed virgin metal surfaces as the continuous form wire assembly is advanced through the plating apparatus.

10. A method for making a wire contact assembly comprising the steps of intermittently advancing a plurality of resilient longitudinally extending insulated solid wire conductors in transversely spaced apart side-by-side relation to each other to and through longitudinally spaced apart first and second work stations, providing a pair of coengageable mating contact carrier sections, one of the contact carrier sections having a plurality of wire receiving grooves formed therein equal in number to said contact wires, positioning each of said contact wires within an associated one of said grooves in the one contact carrier at the first work station, ultrasonically welding the other of said contact carrier sections to the one contact carrier section at the first work station, removing insulating material from the contact wires at selected locations on the contact wires, at the second work station, forming notches in the contact wires at the selected locations to expose virgin metal surfaces of the contact wires after the step of removing insulating material has been performed, plating the exposed virgin metal surfaces of the contact wires with precious metal, shearing the contact wires in spaced relation to the contact carrier to form free end portions of the contact wires, and bending the free end portions of the contact wires to define cantilever free end portions which include the notches.

11. A method for making a wire contact assembly as set forth in claim 10 wherein the step of positioning is further characterized as bowing the contact wires upwardly at the first work station, inserting a first contact carrier section into the first holding fixture below the upwardly bowed contact wires, and allowing the upwardly bowed contact wires to return to longitudinally extending condition within the wire receiving grooves.

* * * * *